US006401354B1

(12) United States Patent
Johnson

(10) Patent No.: US 6,401,354 B1
(45) Date of Patent: Jun. 11, 2002

(54) BLOW DRYER ATTACHMENT FOR PETS

(76) Inventor: Linda Joy Johnson, 1415 11th Ave., San Francisco, CA (US) 94122-3604

( * ) Notice: Subject to any disclaimer, the term of this patent is extended or adjusted under 35 U.S.C. 154(b) by 0 days.

(21) Appl. No.: 09/693,873

(22) Filed: Oct. 23, 2000

(51) Int. Cl.[7] ..... F26B 19/00
(52) U.S. Cl. ..... 34/90; 34/96
(58) Field of Search ..... 34/90, 96, 97; 119/174, 601; D28/18, 3; 239/559; 132/271

(56) References Cited

U.S. PATENT DOCUMENTS

| | | | | | |
|---|---|---|---|---|---|
| 3,313,036 | A | | 4/1967 | Fortune | 34/99 |
| 3,335,502 | A | | 8/1967 | Ritter | 34/99 |
| 3,596,636 | A | * | 8/1971 | Stobaugh | 119/174 |
| 3,609,879 | A | | 10/1971 | Hanizco | 34/99 |
| 4,230,279 | A | * | 10/1980 | Forsberg | 239/559 |
| D259,284 | S | * | 5/1981 | Megna | D28/18 |
| 4,759,135 | A | * | 7/1988 | Scivoletto | 34/97 |
| 4,955,145 | A | * | 9/1990 | Scivoletto | 132/271 |
| 5,036,601 | A | * | 8/1991 | Mulle, Jr. et al. | 34/97 |
| D349,585 | S | | 8/1994 | Rizzuto | D28/18 |
| 5,386,644 | A | * | 2/1995 | Lawall et al. | 34/90 |
| 5,526,578 | A | * | 6/1996 | Iyer | 34/97 |
| 5,761,825 | A | * | 6/1998 | Ammon et al. | 34/97 |
| 5,842,286 | A | * | 12/1998 | Cantor | 34/96 |
| D414,896 | S | | 10/1999 | Goetschi | D28/18 |
| 6,038,782 | A | * | 3/2000 | Schepist | 34/97 |
| D424,741 | S | * | 5/2000 | Rosemzweig | D28/3 |
| 6,058,886 | A | * | 5/2000 | Haines | 119/601 |

OTHER PUBLICATIONS

Promo Dog Drinker & Drier & Patent Application Drawings Johnson copyright filed Jul. 12, 2000.
DD Variation Johnson copyright filed Jul. 27, 2000.
Buckett & Bowi & Drier Johnson copyright filed Aug. 17, 2000.
Application No. 29/125,060 Johnson Jun. 19, 2000.

* cited by examiner

*Primary Examiner*—Teresa Walberg
*Assistant Examiner*—Leonid Fastovsky

(57) ABSTRACT

A blow dryer attachment for pets which delivers diffused warm air at an efficient temperature and coverage area and also allows hands free operation. The blow dryer attachment has a pouch 12 which serves as a diffuser for heated air. The pouch is connected to a blow dryer thru the pouch's aperture 16. The rear aspect of the pouch is connected to a stationary object (such as a wall, doornob, chair, etc) with the means for securing to a stationary object 18. Hot air is transported from the pouch to the pet thru a plurality of holes for air passage 14 in the pouch. A human pet caregiver moves the pouch over the pet's body rotating the dryers to dry the complete pet body. The blow dryer may also be secured to a stationary object (such as a wall, doorknob, or chair) thereby allowing hands free operation. Hot air is transported from the pouch to the pet thru a plurality of holes for air passage 14 in the pouch. The pet self dries. The blow dryer attachment for pets and the blow dryer may also both be secured to a pet's cage. Hot air is transported from the pouch to the pet thru a plurality of holes for air passage 14 in the pouch. The pet self dries.

3 Claims, 5 Drawing Sheets

BLOW DRYER ATTACHMENT FOR PETS

CROSS-REFERENCE TO RELATED APPLICATIONS

This invention utilizes the design of my co-pending application, Application Ser. No. 29/125,060, filed Jun. 19, 2000.

BACKGROUND—FIELD OF INVENTION

This invention relates to a grooming utensil for pets specifically to a blow dryer attachment for pets which can be secured to a stationary object (such as a wall) or between stationary objects (such as walls) allowing hands free operation.

BACKGROUND—DESCRIPTION OF PRIOR ART

Pet animals, especially dogs, get dirty! We humans like to bathe pets, and we like to dry them off! Human hair dryers are well known to be TOO HOT for pets! Pets run the risk of being burnt and/or overheated. Dedicated pet caregivers, especially dog caregivers, try to avoid these problems by keeping their hair driers moving rapidly over the dog. This is time consuming, irritating, and inefficient.

Dog hair driers are priced beginning at about $200. A reasonably priced grooming device which delivers diffused air at a proper temperature with a large enough coverage area, and can also provide a method for hands free operation is necessary to care for our pets.

U.S. Pat. No. D414,896 to Goetschi (1999) and U.S. Pat. No. D349,585 to Rizzuto (1994) show diffuser attachments which fit onto blow dryers. These inventions do not provide a large enough area of diffused air and do not allow a hands free method of operation. Efficiency would not be dramatically improved; the pet owner would still have to move the dryer around quite rapidly.

U.S. Pat. No. 3,313,036 to Fortune (1967), and U.S. Pat. No. 3,335,502 to Ritter (1967), and U.S. Pat. No. 3,609,879 to Hanisco (1971) show bonnet shaped dryers. Such close fit and proximity would be feared, would not be tolerated by pets, and would actually contribute to overheating and burning of pets.

SUMMARY

In accordance with the present invention a blow dryer attachment for pets comprises a pouch having a plurality of holes for air passage, an aperture for insertion of a blow dryer, and means for securing the pouch to a stationary object.

OBJECTS AND ADVANTAGES

It is, therefore, an object of this invention to provide an improved grooming utensil. Accordingly, several objects and advantages are:

(a) to provide an attachment to use for pets which will fit on the human's presently owned blow dryer;

(b)to provide a blow dryer attachment that is sufficiently large that it effectively covers an animal's body with a warm cloud of diffused air;

(c) to provide a blow dryer attachment that that provides air at a temperture low enough to prevent overdrying, overheating, and burning yet is efficient;

(d) to provide a blow dryer attachment that reduces energy and time put out by a human frantically waving his dryer over his pet;

(e)to provide a a blow dryer attachment for pets which can easily be stored in luggage while vacationing;

(f) to provide a blow dryer attachment for pets which is economical and simple to manufacture;

(g) to provide a blow dryer attachment for pets which allows a method of hand free operation;

(h) to to provide a blow dryer attachment for pets which can be secured between two stationary objects thereby creating a warm environment for the pet to self dry in. The pet's bed may be positioned in this warm environment;

(i)to provide a blow dryer attachment for pets which can be secured to a pet's crate, kennel, or cage so that the pet may self dry within his enclosure.

Still further objects and advantages will become apparent from a considertion of the ensuing description and drawings.

DRAWING FIGURES

REFERENCE NUMERALS IN DRAWINGS

12 pouch

Figure 1:
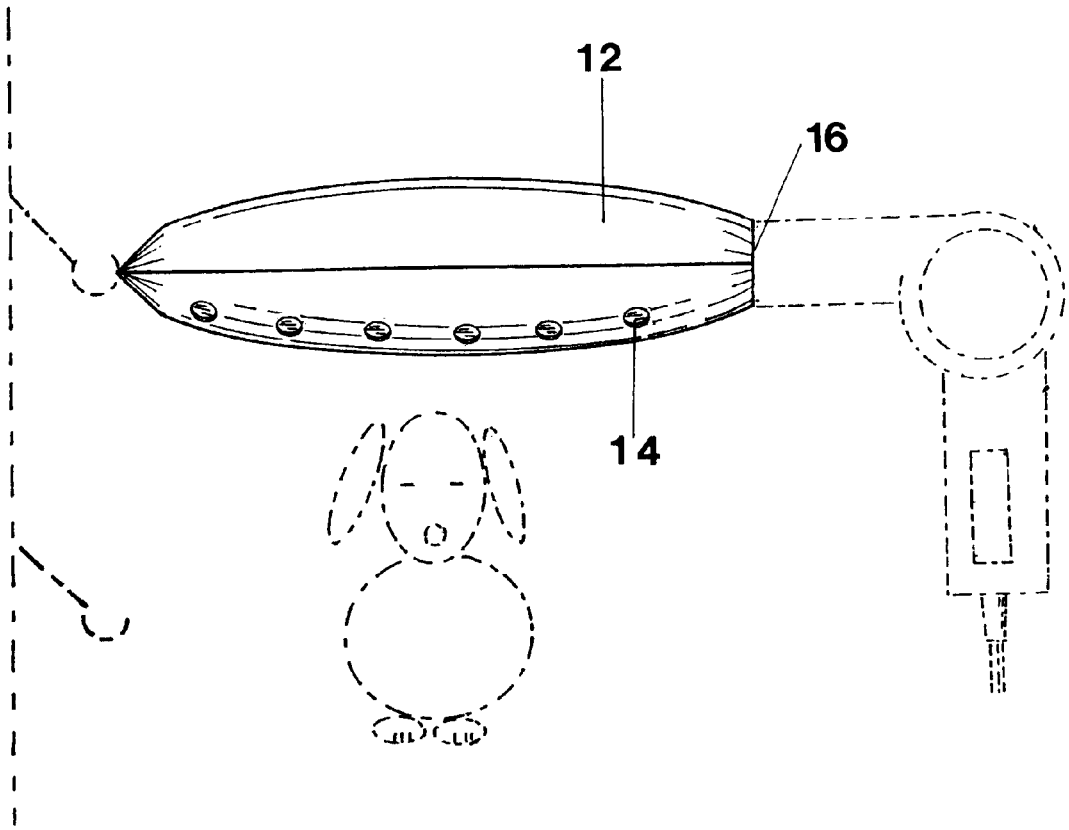
FIG. 1 is a side view of a blow dryer attachment for pets incorporating the invention secured to a wall.

14 plurality of holes for air passage

16 aperture for insertion and attachment of blow dryer

18 means for securing blow dryer attachment to stationary object

DESCRIPTION-FIGS. 1–7 PREFERRED EMBODIMENT

A typical embodiment of the present invention is illustrated in FIGS. 1–7. FIG. 1 and FIGS. 3–7 show a pouch 12 with a plurality of holes for air passage 14 on its bottom aspect. An aperture 16 is provided for insertion and attachment of a blow dryer. Means for securing the blow dryer attachment to a stationary object 18 is provided.

Figure 2:
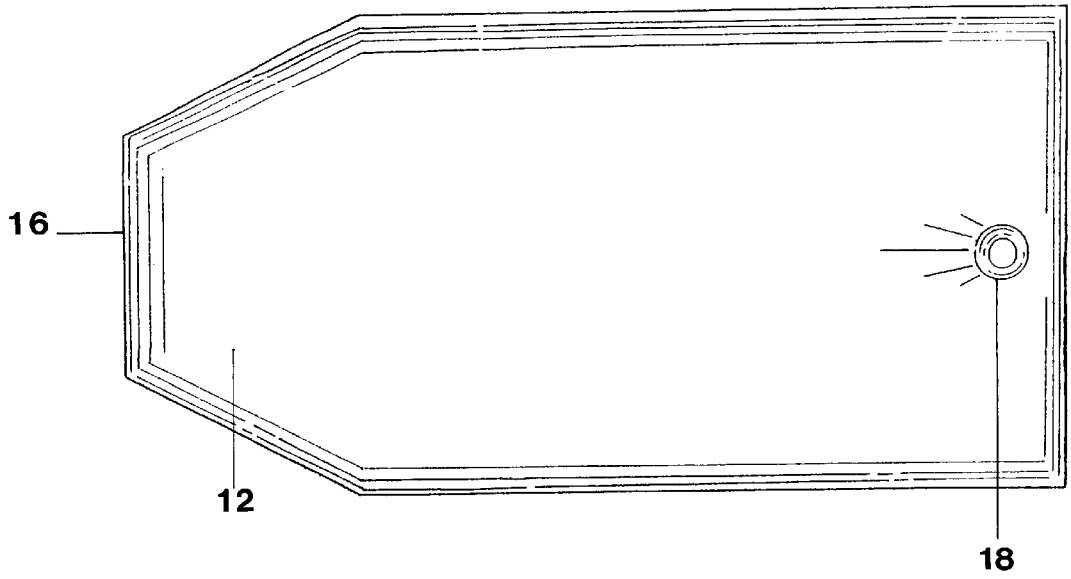
FIG. 2 is a top view of a blow dryer attachment for pets incorporating the invention.
Figure 3:
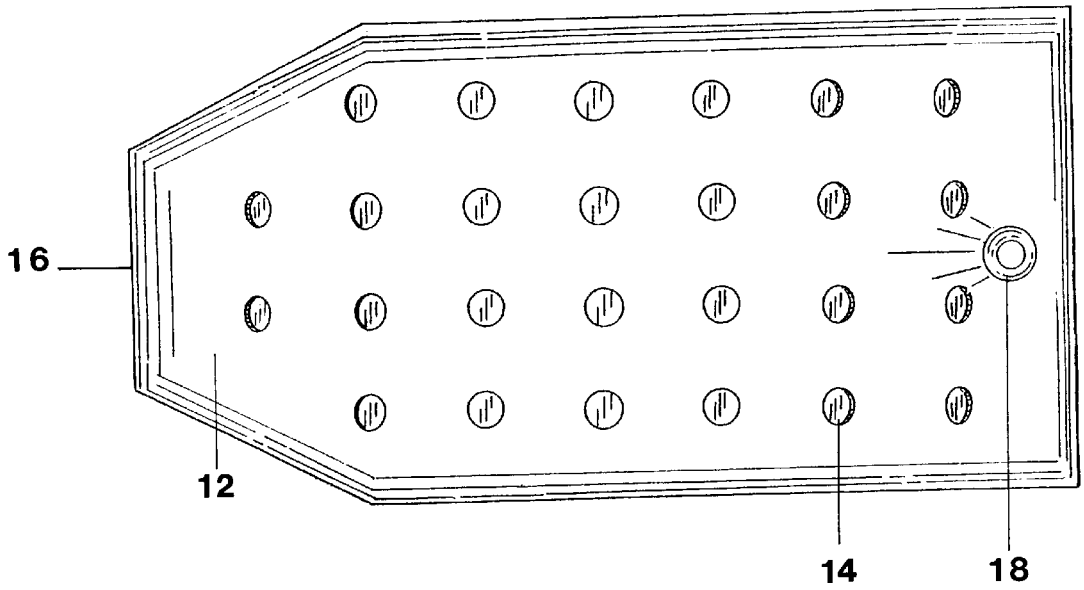
FIG. 3 is a bottom view of a blow dryer attachment for pets incorporating the invention.
Figure 4:
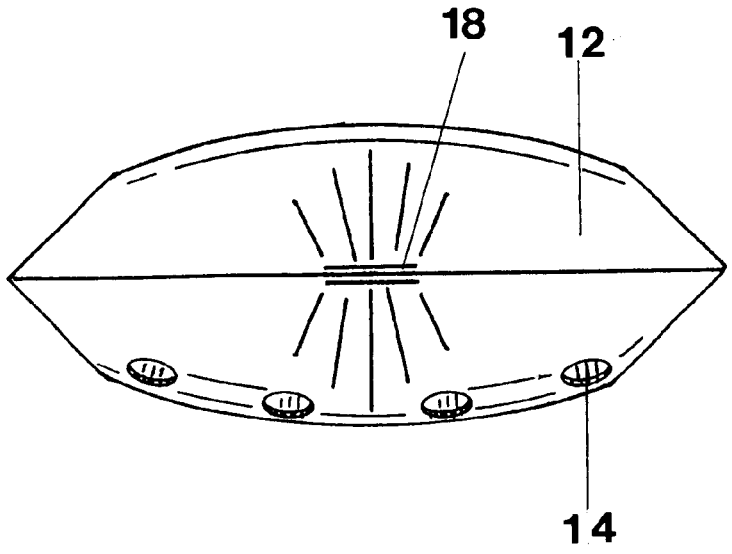
FIG. 4 is a rear view of a blow dryer attachment for pets incorporating the invention.
Figure 5:
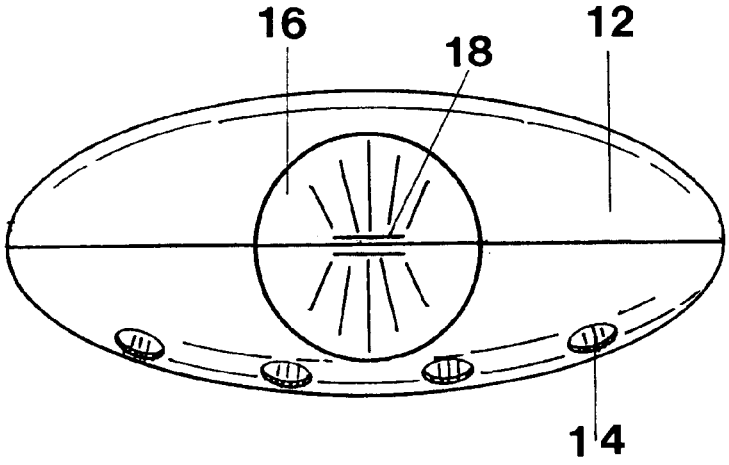
FIG. 5 is a front view of a blow dryer attachment for pets incorporating the invention.

FIG. 2 shows the top of the invention comprising a pouch 12, an aperture 16 for insertion and attachment of a blow dryer, and means for securing the blow dryer attachment to a stationary object 18.

Figure 6:
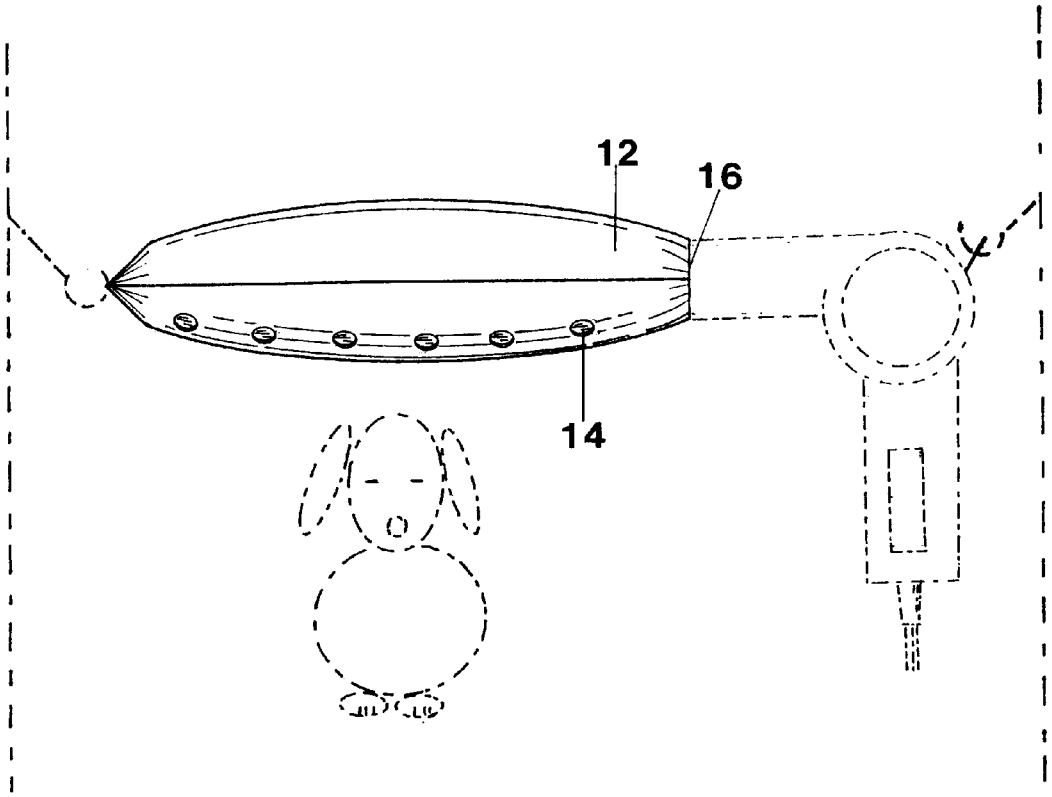
FIG. 6 is a side view of a blow dryer attachment for pets incorporating the invention showing the a hair dryer secured between two walls.
Figure 7:
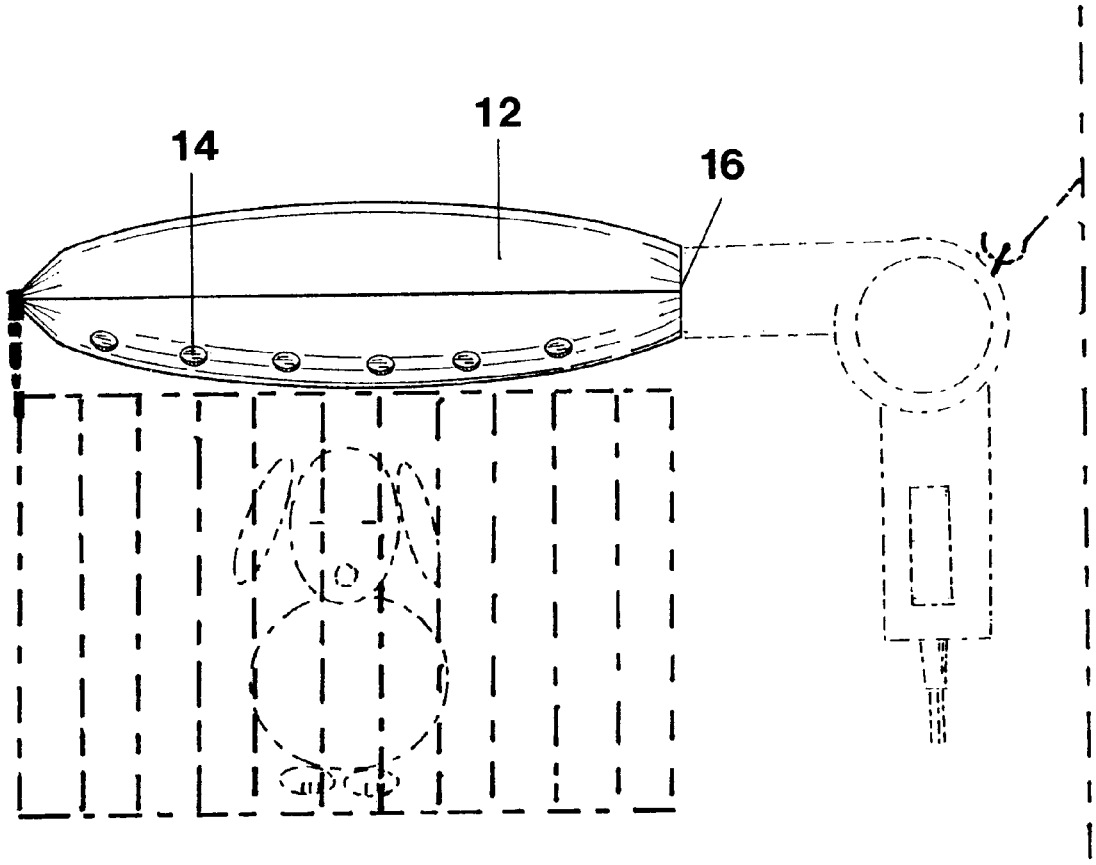
FIG. 7 is a side view of a blow dryer attachment for pets incorporating the invention showing the invention secured to pet's cage.

FIG. 1 shows the pouch 12 secured to a stationary object (a wall). FIG. 6 shows both the invention and the blow dryer secured to stationary objects (walls). FIG. 7 shows the pouch 12 secured to a pet's crate and the blow dryer secured to a stationary object (a wall). The blow dryer may also be secured to the crate or to any other stationary object.

ADVANTAGES

From the description above, a number of advantages of my blow dryer attachment for pets become evident:

(a)it may be used with presently owned blow dryers;

(b)it reduces effort and time used by pet care givers;

(c)it also provides hand free operation.

OPERATION-FIGS. 1–7

With reference now to the drawings, this invention will be described in greater detail.

FIG. 1 shows a pouch 12 which serves as a diffuser for heated air. The pouch 12 is connected to a blow dryer thru the pouch's aperture 16. The rear aspect of the pouch is connected to a stationary object (such as a wall, doornob, chair,etc) with the means for securing to stationary object 18. Hot air is transported from the pouch to the pet thru a plurality of holes for air passage 14 in the bottom aspect of the pouch. A human pet caregiver moves the pouch over the pets body rotating the dryers to dry the complete pet body. Additional hooks (to secure pouch to stationary object) may be installed to aid in changes of the dryers' position while drying entire pet body.

FIG. 6 shows a pouch 12 which serves as a diffuser for heated air. The pouch is connected to a blow dryer thru the pouch's aperture 16. The rear aspect of the pouch is connected to a stationary object (such as a wall, doornob, chair,etc) with the means for securing to stationary object 18. The blow dryer is attached to a stationary object (such as wall, doorknob, or chair) therby allowing hands free operation. Hot air is transported from the pouch to the pet thru a plurality of holes for air passage 14 in the bottom aspect of the pouch. The pet self dries.

FIG. 7 shows a pouch 12 which serves as a diffuser for heated air. Both the pouch 12 (using the means for securing to stationary object 18) and the blow dryer are secured to a pet's cage thereby allowing hands free operation. Hot air is transported from the pouch to the pet thru a plurality of holes for air passage 14 in the bottom aspect of the pouch. The pet self dries.

CONCLUSION, RAMIFICATIONS, AND SCOPE

Thus, the reader will see that the invention provides a blow dryer attachment which protects pets from burning and overheating and requires far less effort and time on the part of the human.

While my above description contains many specificities, these should not be construed as limitations on the scope of the invention, but rather as an exemplification of one preferred embodiment thereof. Many other variations are possible. For example: it may be use for many different animals including but limited to pets.

- it is especially helpful to string dryer across a horse's stall and dry horse's chest while grooming rest of body;
- it is epecially valuable when drying items which must not be disturbed by air flow such as varnish, delicate paintings,fancy hairdos, etc.;
- it may be used to warm dog up from winter walk;
- it may be used to warm rescued wildlife and/or young animals;
- more than one dryer may be used at the same time for extra large animals;
- the size, materials, form, color, and shape of the dryer may vary;
- a tube may be provided between the blow dryer and the pouch to increase the length and reach of the applicance if required;
- the plurality of holes for air passage may be positioned on any one or more aspects of the pouch;
- the hair dryer attachment for pets can be made out of nylon, plastic, or other cloth. It may be sewn, heat sealed, or constructed with some similar method;
- It may be constructed of a rigid material. It may be made using injection, blow, or some other molding process;
- it may be constructed from clear material so that the pet may be seen thru the dryer;
- means for securing to a stationary object may include, but is not limited to grommets, elastic bands, ties, and the like;
- means for securing the attachment to the blow dryer may include, but is not limited to hook and loop material, elastic bands, ties, and the like.

Accordingly, the scope of the invention should be determined not by the embodiment (s) illustrated but by the appended claims and their legal equivalents.

I claim:

1. A blow dryer attachment for pets comprising:

(a) a pouch, said pouch having a plurality of holes for air passage;

(b) an aperture on said pouch for insertion of a blow dryer and (c) means for attaching said pouch to a stationary object.

2. A method for drying pets comprising of the steps of providing:

(a) a pouch, said pouch having a plurality of holes for air passage;

(b) providing an aperture on said pouch for insertion of a blow dryer and (c) providing means for attaching said pouch to a stationary object;

(d) inserting and attaching said pouch to blow dryer;

(e) attaching said pouch to a stationary object;

(f) positioning pet beneath said pouch, and (g) a human caregiver waving said pouch over pet's body until pet is dry.

3. A method for drying pets comprising of the steps of providing:

(a) a pouch, said pouch having a plurality of holes for air passage;

(b) providing an aperture on said pouch for insertion of a blow dryer and (c) providing means for attaching said pouch to a stationary object;

(d) inserting and attaching said pouch to blow dryer;

(e) attaching said pouch to a stationary object;

(f) positioning pet beneath said pouch, and (g) allowing the pet to self dry.

* * * * *